United States Patent [19]

Hirose et al.

[11] Patent Number: 4,788,050

[45] Date of Patent: Nov. 29, 1988

[54] PROCESS FOR PRODUCING PITCH-BASED CARBON FIBERS

[75] Inventors: Takao Hirose, Kamakura; Yoshio Sohda; Kazuyoshi Okamoto, both of Kawasaki; Seiichi Uemura, Tokyo, all of Japan

[73] Assignee: Nippon Oil Company, Limited, Japan

[21] Appl. No.: 31,935

[22] Filed: Mar. 27, 1987

[30] Foreign Application Priority Data

Mar. 28, 1986 [JP] Japan ..... 61-68746

[51] Int. Cl.[4] ..... D01F 9/12

[52] U.S. Cl. ..... 423/447.2; 423/447.1; 423/447.4; 423/447.6; 264/29.2; 264/29.5

[58] Field of Search ..... 423/447.1, 447.2, 447.4, 423/447.6; 264/29.2, 29.5

[56] References Cited

U.S. PATENT DOCUMENTS

| | | | |
|---|---|---|---|
| 3,671,385 | 6/1972 | Trent et al. | 423/447.2 |
| 3,682,595 | 8/1972 | Okuda et al. | 423/447.1 |
| 4,335,089 | 6/1982 | Maruyama et al. | 423/447.4 |
| 4,466,949 | 8/1984 | Mori | 423/447.4 |
| 4,501,037 | 2/1985 | Lay et al. | 423/447.4 |
| 4,548,703 | 10/1985 | Pickakian | 423/447.4 |
| 4,579,645 | 4/1986 | Uemura et al. | 423/447.2 |

*Primary Examiner*—John Doll
*Assistant Examiner*—Robert M. Kunemund
*Attorney, Agent, or Firm*—Scully, Scott, Murphy & Presser

[57] ABSTRACT

In a process for producing carbon fibers from a carbonaceous pitch, the improvement characterized in that an end portion of infusiblized fiber or carbonized fiber to be first subjected to a carbonizing or graphitizing treatment and that of infusiblized fiber or carbonized fiber to be next subjected to the same treatment are bonded together using a composition comprising (a) at least one member selected from the group consisting of phenolic resins and pitches and (b) graphite powder, and the thus-bonded fibers are fed successively to a carbonizing apparatus or a graphitizing apparatus.

5 Claims, No Drawings

PROCESS FOR PRODUCING PITCH-BASED CARBON FIBERS

BACKGROUND OF THE INVENTION

1. Field of the Invention

The present invention relates to a process for producing pitch-based carbon fibers and more particularly to an improvement in a process for producing carbon fibers from a carbonaceous pitch.

2. Description of the Prior Art

According to a conventional process for producing carbon fibers, a bundle of fibers to be treated are placed in a furnace at room temperature, then after or while the temperature of the furnace is raised to a treating temperature, the fiber bundle is moved and subjected to carbonization or graphitization treatment. In this case, however, for treating the next fiber bundle after treatment of the previous fiber bundle it is necessary to once reduce the furnace temperature and then place the fiber bundle to be treated in the furnace. Consequently, the furnace utilization efficiency is low and there arise problems such as an increase of electric charges caused by the rise of temperature and thermal damages of various portions caused by the rise and lower of temperature. They are a cause of increased cost.

SUMMARY OF THE INVENTION

It is an object of the present invention to solve the above-mentioned problems and provide a process for producing carbon fibers efficiently.

It is another object of the present invention to provide an improvement in a process for producing carbon fibers from a carbonaceous pitch which improvement is characterized in that a trailing end of a fiber bundle to be subjected to carbonization or graphitization treatment and a leading end of a second fiber bundle to be treated next are bonded together to attain an efficient production of pitch-based carbon fibers.

The present invention resides in an improvement in a process for producing pitch fiber, infusiblized fiber, carbonized fiber and, if desired, graphitized fiber in this order from a carbonaceous pitch, which improvement is characterized in that an end portion of infusiblized fiber or carbonized fiber to be first subjected to a carbonizing or graphitizing treatment and that of infusiblized fiber or carbonized fiber to be next subjected to the same treatment are bonded together using a composition comprising (a) at least one member selected from the group consisting of phenolic resins and pitches and (b) graphite powder, and the thus-bonded fibers are fed successively to a carbonizing apparatus or a graphitizing apparatus.

DESCRIPTION OF THE PREFERRED EMBODIMENTS

The "carbon fiber" as referred to herein usually includes graphite fiber, but "graphite fiber" will be referred to when only graphite fiber is to be shown.

Examples of the carbonaceous pitch used in the present invention include coal pitches such as coal tar pitch and SRC, petroleum pitches such as ethylene tar pitch and decant oil pitch, and synthetic pitch, with petroleum pitches being particularly preferred.

Pitches obtained by modification of the above pitches are also included in the carbonaceous pitch referred to herein, such as, for example, pitch which has been treated with a hydrogen donor, e.g. tetralin, pitch which has been hydrogenated under a hydrogen pressure of 20–350 kg/cm$^2$, pitch which has been modified by heat treatment, and pitch which has been modified by a suitable combination of these methods.

Thus, the "carbonaceous pitch" as referred to herein is a general term for precursor pitches capable of forming pitch fibers.

The carbonaceous pitch used in the present invention may be an optically isotropic pitch, or it may be an optically anisotropic pitch. The optically anisotropic pitch is obtained, for example, by heat-treating a pitch usually at 340°–450° C. while passing an inert gas such as nitrogen gas, or without passing such inert gas, under atmospheric pressure or reduced pressure. Preferably, it has an optically anisotropic phase (so-called mesophase) content of 5% to 100%, more preferably 60% to 100%.

The carbonaceous pitch used in the present invention has a softening point preferably in the range of 240° to 400° C., more preferably 260° to 300° C.

Pitch fiber is obtained by melt-spinning the carbonaceous pitch by a known method. Usually, pitch fiber is obtained by melting the carbonaceous pitch at a temperature higher than the softening point thereof, for example, higher by 30° to 80° C., and extruding the resulting melt through a nozzle 0.1 to 0.5 mm in diameter while taking up the resultant filaments onto a bobbin at a rate of 100–2000 m/min or allowing the filaments to be deposited on a container or a belt conveyor.

The pitch fiber is subjected to an infusiblizing treatment in an oxidative gas atmosphere at a temperature usually not higher than 400° C., preferably in the range of 50° to 380° C., more preferably 100° to 350° C., If the treatment temperature is too low, a longer treating time will be required, and if the treatment temperature is too high, there will arise such a phenomenon as fusing or wastage of the pitch fiber. Thus, both such too high and too low temperatures are not desirable. As the oxidative gas, usually one or more of such oxidative gases as oxygen, ozone, air, nitrogen oxides, sulfur oxides and halogen are employed. Particularly preferred are air containing 0.1 to 20 vol. % of nitrogen dioxide, and oxygen. The treatment time is in the range of 1 minute to 20 hours, preferably 2 minutes to 10 hours.

The "infusiblized fiber" as referred to herein represent fiber obtained by subjecting the pitch fiber to the infusiblizing treatment, and the "carbonized fiber" as referred to herein includes both precarbonized fiber obtained by calcining the infusiblized fiber in an inert gas atmosphere at a temperature not higher than 800° C., preferably in the range of 400° to 700° C., more preferably 450° to 600° C., and carbonized fiber obtained by calcining the infusiblized fiber or the precarbonized fiber in an inert gas atmosphere at a temperature in the range of 800° to 1,300° C., preferably 900° to 1,200° C.

In the present invention, an end portion of infusiblized fiber or carbonized fiber to be first subjected to a carbonizing or graphitizing treatment and that of infusiblized fiber or carbonized fiber to be next subjected to the same treatment are bonded together using a composition comprising (a) at least one member selected from the group consisting of phenolic resins and pitches and (b) graphite powder, and the thus-bonded fibers are fed successively to a carbonizing apparatus or a graphitizing apparatus.

Examples of the pitch include coal pitches such as coal tar pitch and SRC, petroleum pitches such as ethylene tar pitch and decant oil pitch, and synthetic pitch, with petroleum pitches being particularly preferred. The pitch has a softening point in the range of 240° to 400° C., preferably 260° to 300° C.

The graphite powder is of a particle diameter preferably in the range of 0.1 μm to 2 mm and its proportion is in the range of 10 to 90 parts by weight per 100 parts by weight of phenolic resin and/or pitch.

In bonding fiber end portions, the above composition may be diluted with a solvent in order to improve the working efficiency. As the solvent there may be used any of various alcohols. The amount of the solvent is in a range capable of maintaining adhesion sufficient to exhibit bonding force. It is also preferable that the bonded portion be subjected to a calcining treatment before the fibers are fed to the carbonizing apparatus or the graphitizing apparatus. This calcining treatment may be done in an inert gas at 300°-1,000° C., or it may be done by merely placing the bonded portion in a flame for a short time.

The bonding is usually carried out between the trailing end of a first fiber bundle and the leading end of a second fiber bundle to be treated next. It may be done where required in the course of a continuous treating process, or it may be done in advance.

The following examples are given to further illustrate the present invention, but it is to be understood that the invention is not limited thereto.

EXAMPLE 1

A bundle of pitch fibers having an average diameter of 12μ was obtained by spinning an optically anisotropic pitch having a softening point of 280° C. This pitch fiber bundle was infusiblized in air containing 5% $NO_2$ at 225° C. for 1 hour and thereafter subjected to a precarbonizing treatment at 700° C.

The thus-precarbonized fiber bundle was then subjected to a graphitizing treatment, which was carried out by delivering the precarbonized fiber bundle from a first delivery bobbin, passing it for 10 seconds through a graphitizing apparatus held at 2,500° C. and thereafter winding it onto a first take-up bobbin. In this way the graphitizing treatment was conducted for 10 hours. When the volume of the precarbonized fiber bundle on the first delivery bobbin became small, the delivery was stopped and an end portion thereof was bonded with that of the precarbonized fiber bundle on the second delivery bobbin. The bonding was carried out in the following manner. To 100 parts by weight of a phenolic resin and 50 parts by weight of graphite powder was added ethyl alcohol, and end portions of the two fiber bundles were bonded together using the resulting composition, then the bonded portion was dried at room temperature for 10 minutes and placed in a flame for 3 seconds. Thereafter, the delivery was performed again, and when the bonded portion came out of the graphitizing apparatus, the integrated fiber bundle was cut followed by winding onto the second take-up bobbin.

In this way the fiber bundles on two bobbins could be treated in a total time of 21 hours.

COMPARATIVE EXAMPLE 1

In the same manner as in Example 1 the precarbonized fiber bundle was delivered from the first delivery bobbin and graphitized, then wound up onto the first take-up bobbin. Upon completion of the winding the temperature of the graphitizing apparatus was reduced. After the interior of the apparatus had been cooled to a sufficient extent, the precarbonized fiber on the second delivery bobbin was set into the graphitizing apparatus and the temperature of the apparatus was raised again to effect the graphitizing treatment. It took a total of 36 hours to treat the fiber bundles on two bobbins.

EXAMPLE 2

In place of the phenolic resin used in Example 1 the bonding between end portions of the fiber bundles on the first and second delivery bobbins was performed using a petroleum pitch having a softening point of 270° C. More particularly, a mixture consisting of 100 parts by weight of the pitch and 50 parts by weight of graphite powder was melted and end portions of the two fiber bundles were bonded together using the melt, then the bonded portion was solidified at room temperature over a 2 minute period and then put in a flame for 3 seconds. Thereafter, the delivery was conducted again and when the bonded portion came out of the graphitizing apparatus, the integrated fiber bundle was cut followed by winding onto the second take-up bobbin.

In this way the fiber bundles on two bobbins could be treated in a total time of 21 hours.

What is claimed is:

1. In a process for producing carbon fibers from a carbonaceous pitch, the improvement characterized in that a trailing end portion of infusibilized fiber or carbonized fiber to be first subjected to a carbonizing or graphitizing treatment and the leading end of infusibilized fiber or carbonized fiber to be next subjected to the same treatment are bonded together using a composition consisting essentially of (a) at least one member selected from the group consisting of phenolic resins and pitches and (b) graphite powder in an amount in the range of 10 to 90 parts by weight per 100 parts by weight of component (a); wherein said bonding is carried out prior to or subsequent to the infusibilization of said fibers, and the thus-bonded fibers are fed successively to a carbonizing apparatus or a graphitizing apparatus.

2. A process according to claim 1, wherein the bonding pitches range in softening point from 240° to 400° C.

3. A process according to claim 1 wherein said composition further comprises (c) a solvent.

4. A process according to claim 3 wherein said solvent is an alcohol.

5. A process according to claim 4 wherein said alcohol is ethyl alcohol.

* * * * *